United States Patent [19]

Larsson

[11] Patent Number: 4,610,434

[45] Date of Patent: Sep. 9, 1986

[54] SAFETY ARRANGEMENT IN GAS-CUTTING LANCES

[75] Inventor: Arne Larsson, Stockholm, Sweden

[73] Assignee: Svensk Termo-Ekonomi AB, Bromma, Sweden

[21] Appl. No.: 702,235

[22] PCT Filed: May 18, 1984

[86] PCT No.: PCT/SE84/00194

§ 371 Date: Jan. 18, 1985

§ 102(e) Date: Jan. 18, 1985

[87] PCT Pub. No.: WO84/04777

PCT Pub. Date: Dec. 6, 1984

[30] Foreign Application Priority Data

May 20, 1983 [SE] Sweden ..... 8302894

[51] Int. Cl.[4] ..... B23K 7/08

[52] U.S. Cl. ..... 266/75; 266/225; 266/270

[58] Field of Search ..... 266/74, 75, 225, 270

[56] References Cited

U.S. PATENT DOCUMENTS 1,793,849 2/1931 Groninger ..... 266/270
1,844,194 2/1932 Von Maltitz ..... 266/270
2,210,640 8/1940 Swafford ..... 148/9 C
4,239,194 12/1980 Debaise ..... 266/270

*Primary Examiner*—Wayland Stallard
*Attorney, Agent, or Firm*—Nies, Webner, Kurz & Bergert

[57] ABSTRACT

A safety arrangement in a so-called gas-cutting lance (1) arranged to be connected at one end (2) thereof, the attachment end, to a gas-supply handle (3) or like means for causing gas, primarily oxygen gas, to flow through the lance. The lance comprises a hollow tube (5) which preferably houses a core (6) of, for example, closely packed filaments (7). The tube and the core comprise a material having a high iron content and are intended to melt progressively at the free end of the lance and to burn, to oxidize, at least in part.

The arrangement is characterized in that preferably at least the lance (1) includes at least one substantially tubular sleeve (8,9) or like member in the vicinity of the attachment end (2) of the lance. The lance in the aforesaid vicinity of the attachment end (2) is devoid of any core material, and each sleeve (8,9) is made of a material which will arrest or prevent the melting and burning process, the arrangement being such that the lance (1) will be extinguished when the melting and burning process reaches the sleeve or sleeves (8,9).

13 Claims, 3 Drawing Figures

Fig. 1
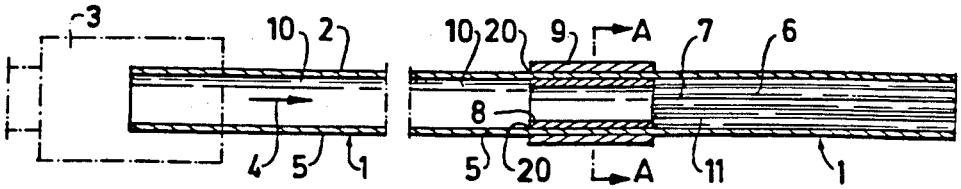
Fig. 2
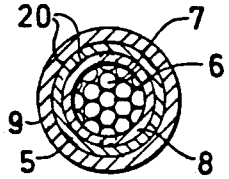
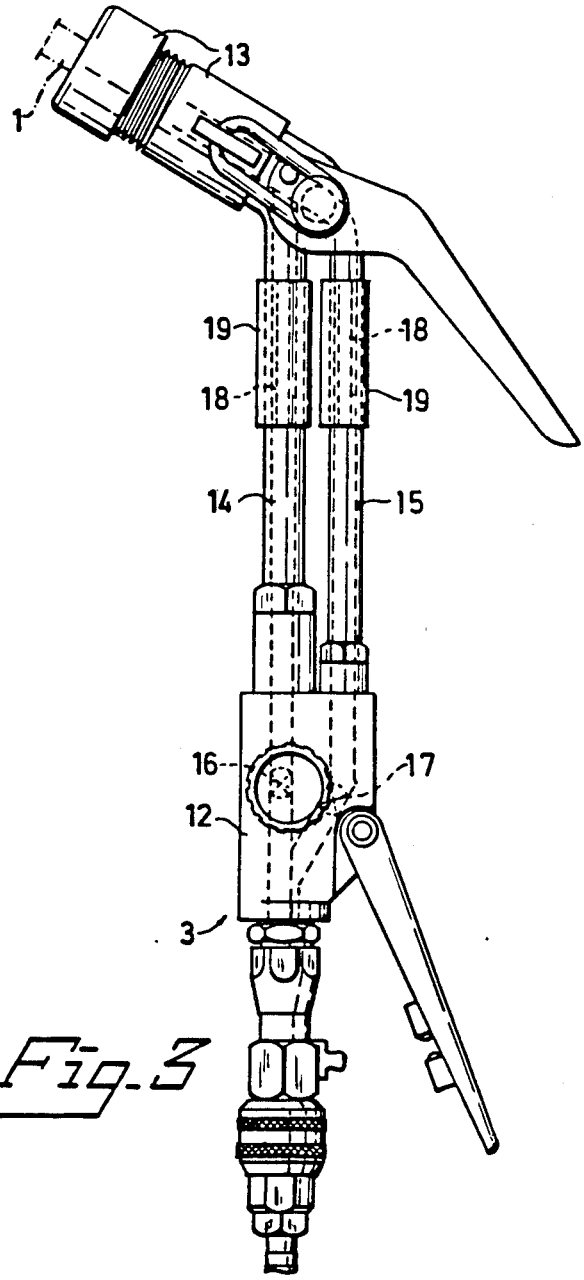
Fig. 3

SAFETY ARRANGEMENT IN GAS-CUTTING LANCES

The present invention relates to a safety arrangement in so-called gas-cutting lances in which the lance is connected at one end thereof to a gas-supply handle or like device for the supply of gas therethrough, primarily oxygen gas, and in which the other end of the lance is progressively consumed.

Cutting lances of this kind are used, inter alia, for making holes in concrete structures and truncating heavy metal pieces, and comprise a hollow tubular casing, normally made of iron or non-alloyed steel, which often has arranged therein a core of tightly packed, axially extending steel wires. Embodiments are known in which this core comprises a powderous mixture.

One problem with such cutting lances is that the whole of a lance can be consumed, resulting in injury to the workman and the handle or like device, and in the release of gas to the surroundings, which in many cases may have serious consequences. An object of the invention is therefore to provide a safety arrangement, so as to eliminate this problem.

Thus, the present invention relates to a safety arrangement in so-called gas-cutting lances of the kind in which the lance is connected at one end thereof, the attachment end, to a gas-supply handle or like device by which gas, primarily oxygen gas, can be caused to pass through the lance; in which the lance comprises a hollow tube having arranged therein a core preferably comprising e.g. tightly packed filaments; and in which the tube and the core have a high iron content and are intended to progressively melt away at the free end of the lance, and to be at least partially combusted, oxidized.

The invention is particularly characterized in that preferably at least said lance includes at least one substantially tubular sleeve or like member arranged adjacent the attachment end of the lance; in that this attachment end is void of core material; and in that said at least one sleeve is intended and arranged to prevent or terminate melting and combustion of the lance and core material, such that the lance is extinguished when melting and combustion of the lance has reached said at least one sleeve.

The invention will now be described in more detail with reference to an embodiment thereof illustrated in the accompanying drawing, in which FIG. 1 is a schematic longitudinal sectional view of part of a lance designed in accordance with the invention;

FIG. 2 is a sectional view taken on the line A—A in FIG. 1; and

FIG. 3 illustrates a handle for a lance according to the invention.

FIG. 1 illustrates a so-called gas-cutting lance 1, which is arranged to be attached at one end 2 thereof, its attachment end, to a handle 3, shown in phantom lines in FIG. 1, by means of which gas, primarily oxygen gas, can be caused to flow through the lance 1, as indicated by the arrow 4 in FIG. 1. The lance comprises a hollow tube or pipe 5, preferably having a core 6 of e.g. closely packed wire filaments 7 arranged therein. The tube 1 and the core are preferably made of low-carbon, substantially non-alloyed steel, i.e. a material of high iron content, and are intended to melt away progressively at the free end of the lance, not shown, and to be at least partially combusted, oxidized.

In accordance with the invention, at least the lance 1 includes at least one substantially tubular sleeve or like member. The embodiment illustrated in FIGS. 1 and 2 includes two such sleeves, an internal sleeve 8 and an external sleeve 9. The sleeves 8, 9 are located adjacent the lance-attachment end 2. At the lance-attachment end 2 the lance has extending from said end a region 10 which is void of core material, this region extending over a suitable distance, such as from 1–2 decimeters for example. The sleeves 8, 9 are suitably placed at the coreless region 10 of the lance 1, contiguous with the core-filled region 11 thereof, and overlap each other in the manner shown in FIG. 1. The sleeves 8, 9 are suitably of noticeable length, for example in the order of some few centimeters and are also of noticeable thickness.

Each sleeve 8, 9 is preferably made of a material which will arrest the melting and combustion of the lance. Suitable materials herefor are given hereinafter.

As beforementioned, preferably at least the lance 1 is provided with a sleeve or sleeves in accordance with the aforegoing. It will be understood however, that one or more such sleeves can be arranged on the handle 3 in a corresponding manner. In this case the lance sleeves can either be omitted, or the lance may be provided with a sleeve or sleeves in addition to those on the handle. By way of example, there is illustrated in FIG. 3 a handle 3 according to Swedish Patent Application No. 8302651-8, comprising a valve housing 12, a connect piece 13 for attachment of a lance 1 to the handle 3, and two gas pipes 14, 15 which extend between the valve housing 12 and the connector piece 13. In this embodiment, the pipe 14 is intended to convey ignition gas, the flow of which is controlled by means of a valve 16, while the pipe 15 is intended to convey cutting gas, the flow of which is controlled by means of a valve 17. Suitably, each pipe 14, 15 is provided with at least a single sleeve of the aforesaid kind. In the illustrated embodiment, however, each sleeve has arranged thereon two sleeves 18, 19, and internal sleeve 18 and an external sleeve 19, as shown in FIG. 3. In the case of a conventional handle comprising only a gas pipe, i.e. having only one pipe, the sleeve or sleeves is, or are, arranged on said pipe.

Each sleeve 8, 9; 18, 19, irrespective of whether it is mounted on the lance 1 or on the handle 3, lies adjacent the through-flow passages 14, 15 of the lance and/or the handle, and is bonded thereto in some suitable fashion, for example by means of a layer 20 of binding agent as illustrated in FIGS. 1 and 2, this binding agent comprising, for example, water-glass or some other appropriate binder. The sleeve may also be secured in some other way, for example mechanically, by deforming the sleeve.

The functional mode of the arrangement according to the invention will be fairly obvious from the aforegoing. Under normal working conditions, when ignited the lance 1 will burn and melt progressively at its free end during a cutting operation, with a continued supply of oxygen gas. Combustion, oxidation, is sustained, inter alia, by the core 6, the specific surface of which is large relative to its volume. When only a small part of the lance 1 remains adjacent the handle 3 or the like, the supply of gas is cut-off, thereby extinguishing the lance, which is then replaced with a fresh lance. With the arrangement according to the invention the lance is extinguished even if the supply of gas is unintentionally left on. The core-free region 10 of the lance, void of wire-like filaments or the like, impairs the melting and combustion conditions. The presence of sleeve or sleeves 8, 9 which are made of a material poor in iron and having a high melting point and low oxidizing tendencies under the conditions in question, further impair the conditions for continued melting and combustion of the lance tube 5 to an extent such that burning ceases and the lance is extinguished. In the event, for example, that a lance according to the invention is not used, and the lance is allowed to melt and burn up to the handle 3, the handle 3 is also liable to burn and melt progressively, which is highly undesirable of course and which may result in the release of a not-readily stopped stream of gas, therewith creating the risk of a serious accident. This melting and burning of the handle is arrested by means of the sleeve or sleeves fitted thereto, in the same manner aswith the lance, the sleeve, or sleeves, being placed so as to arrest the aforesaid burning and melting process before it reaches the valve housing, or like fitting.

The sleeves ar preferably made from a material which will not tend to burn, be oxidized, under the conditions prevailing at the point of the burning and self-consuming lance, despite the presence of oxygen gas. A metallic material suitable in this context and of attractive price is stainless steel of high chromium content. Other metallic materials of high melting points, relatively low iron contents, and low oxidation tendencies can also be used, however. Other materials suitable in this context include ceramics, such as sintered metal oxides. It is also possible to use a composite material, such as metal with ceramic material, or sleeve means which include a metallic and a ceramic sleeve.

As will be understood from the aforegoing, the arrangement according to the invention affords an increased safety measure with the use of particularly simple and inexpensive means.

Although the invention has been described with reference to particular embodiments thereof, it will be understood that other embodiments are conceivable and that minor modifications can be made without departing from the spirit of the invention. Thus, several sleeve materials can be chosen which fulfill the aforesaid purpose. It is conceivable to use sleeves with high iron content, such as cast iron or low-alloyed or non-alloyed steel, although in this case the sleeves must be given a wall thickness which will ensure the arresting function of the sleeves, this wall thickness being greater than that of sleeves made from material poor in iron and possessing low oxidation tendencies.

The sleeves may also have the form of a solid, sintered body or of a body comprising turns of wire or strip.

The invention may also be applied with lances which have no core, or in which the core comprises a sintered body or a core of some other form.

The sleeves may also conceivably be produced from board, preferably impregnated board, or like material.

In the aforegoing water-glass and glue have been mentioned as a suitable binder. Other binders can also be used, however, for example other silicates, suitably glass or the like. Suitably, there is chosen a binder which will itself tend to arrest the melting and burning process. It is also possible, of course, to secure the sleeves both with the aid of a combination of binder and mechanical means.

The invention is thus not restricted to the aforedescribed embodiments, but that modifications can be carried out within the scope of the following claims.

I claim:

1. In a gas-cutting lance in which one end of the lance, the attachment end, is connected to a gas-supply means such as a handle through which gas, e.g., oxygen, can be caused to flow through said lance, the lance comprising a hollow tube in which there is normally arranged a core of closely packed filaments, the tube and core, if present, comprise material of high iron content and being intended to melt progressively at the free end thereof and to combust, oxidize, at least partially: the improvement of safety sleeve means comprising at least one substantially tubular sleeve (8, 9) member located in the vicinity of the attachment end (2) of the lance, a portion (5) of the hollow-tube of the lance being devoid of core material (6) in said vicinity of said attachment end; and in that each sleeve (8, 9) being made from a material intended and arranged to surround the gas flow-path and to prevent or arrest said melting and burning process, so as to extinguish the combustion of said lance when said melting and burning thereof reaches said at least one sleeve (8, 9).

2. The improvement in a gas-cutting lance according to claim 1, wherein the lance (1) includes at its attachment end (2) a coreless region (10) which extends from said attachment end along a suitable distance, approximately 1-2 dm, and in that at least one said sleeve (8, 9) is located on the lance at said coreless region (10) and adjacent the core-filled portion, (11) of the lance (1).

3. The improvement according to claim 1, wherein the gas supply means includes a handle comprising: connector means for connecting a lance thereto; a valve housing which incorporates at least one valve for regulating the flow of gas; and at least one gas-supply pipe extending between the valve housing and said connector means; the improvement being that said gas-supply pipe (14, 15) includes at least one said safety sleeve (18, 19) for arresting or preventing said melting and burning process of the lance.

4. The improvement according to claim 1, wherein the sleeve means comprises two sleeves (8, 9; 18, 19), an internal sleeve (8, 18) and an external sleeve (9, 19), said two sleeves essentially overlapping one another.

5. The improvement according to claim 1, wherein said safety sleeve means comprise, a material which is poor in iron relative to the lance material and which has a high melting point and low oxidation tendencies.

6. The improvement according to claim 1, wherein each sleeve (8, 9; 18, 19) joins with the part (10, 14, 15) on which it is arranged and is fixed thereto.

7. The improvement according to claim 6, wherein each sleeve is fixed by the aid of a binder, said binder being an adhesive.

8. The improvement according to claim 7, wherein said adhesive is a silicate, such as water glass.

9. The improvement according to claim 6, wherein each sleeve is mechanically fixed on the associated part.

10. The imprisonment according to claim 9, wherein the mechanical fixing is by deformation.

11. The improvement according to claim 9, wherein the mechanical fixing includes mechanical fastener means.

12. The improvement according to claim 5, wherein the material which said safety sleeve means comprises is stainless steel of high chromium content.

13. The improvement according to claim 5, wherein the material which said safety sleeve means comprises is a ceramic material, e.g., sintered metal oxide.

* * * * *

UNITED STATES PATENT AND TRADEMARK OFFICE

CERTIFICATE OF CORRECTION

PATENT NO. : 4,610,434

DATED : September 9, 1986

INVENTOR(S) : Arne Larsson

It is certified that error appears in the above-identified patent and that said Letters Patent is hereby corrected as shown below:

Column 4, line 58, change "imprisonment" to --improvement--.

Signed and Sealed this

Eleventh Day of November, 1986

*Attest:*

DONALD J. QUIGG

*Attesting Officer*

*Commissioner of Patents and Trademarks*